US008936339B2

(12) United States Patent
Horie et al.

(10) Patent No.: US 8,936,339 B2
(45) Date of Patent: Jan. 20, 2015

(54) RECORDING APPARATUS AND RECORDING MEDIUM CONVEYANCE METHOD

(71) Applicant: Seiko Epson Corporation, Tokyo (JP)

(72) Inventors: Seijun Horie, Nagano (JP); Kenji Hatada, Nagano (JP); Junya Kato, Nagano (JP); Hideo Uruma, Nagano (JP); Koji Niioka, Nagano (JP); Shinichi Kamoshida, Saitama (JP); Takuya Fujita, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 105 days.

(21) Appl. No.: 13/675,218

(22) Filed: Nov. 13, 2012

(65) Prior Publication Data

US 2013/0120488 A1 May 16, 2013

(30) Foreign Application Priority Data

Nov. 16, 2011 (JP) ..... 2011-250786
Nov. 17, 2011 (JP) ..... 2011-251347
Nov. 22, 2011 (JP) ..... 2011-255104

(51) Int. Cl.

| | |
|---|---|
| ***B41J 29/38*** | (2006.01) |
| ***B41J 2/01*** | (2006.01) |
| ***B41J 11/00*** | (2006.01) |
| ***B41J 11/42*** | (2006.01) |
| ***B41J 15/04*** | (2006.01) |

(52) U.S. Cl.

CPC ..... *B41J 11/007* (2013.01); *B41J 11/001* (2013.01); *B41J 11/42* (2013.01); *B41J 15/04* (2013.01)

USPC ..... 347/16; 347/104; 347/105

(58) Field of Classification Search

CPC ..... B41J 29/393; B41J 15/04; B41J 11/007; B41J 11/0085; B41J 11/0095

USPC ..... 347/16, 104, 105

See application file for complete search history.

(56) References Cited

U.S. PATENT DOCUMENTS

| | | | |
|---|---|---|---|
| 8,002,214 | B2 | 8/2011 | Genta et al. |
| 8,147,023 | B2 | 4/2012 | Hatada et al. |
| 2009/0245912 | A1 | 10/2009 | Igarashi et al. |
| 2010/0053251 | A1 | 3/2010 | Igarashi et al. |

FOREIGN PATENT DOCUMENTS

| | | | |
|---|---|---|---|
| JP | 2007-290866 | A | 11/2007 |
| JP | 2009-242048 | A | 10/2009 |
| JP | 2009-255496 | A | 11/2009 |
| JP | 2009-256095 | A | 11/2009 |
| JP | 2009-280398 | A | 12/2009 |
| JP | 2010-052379 | A | 3/2010 |

*Primary Examiner* — Jannelle M LeBron

(74) *Attorney, Agent, or Firm* — Global IP Counselors, LLP

(57) ABSTRACT

A recording apparatus includes an ink discharge part, a first drive part that drives a rotation of a roll body in which the recording medium is wound, a second drive part that drives the conveyance part that conveys the recording medium, and a control part that controls operations of the first drive part and the second drive part. The control part drives the first drive part in a halted state of the second drive part and executes a measurement that measures a relationship between a load and a drive speed when conveying the recording medium and the control part executes the measurement for a single rotation of the roll body. The control part also provides a first measurement mode to execute the single rotation which is divided into plural number.

11 Claims, 8 Drawing Sheets

RECORDING APPARATUS AND RECORDING MEDIUM CONVEYANCE METHOD

CROSS-REFERENCE TO RELATED APPLICATIONS

This application claims priority to Japanese Patent Application No. 2011-250786 filed on Nov. 16, 2011, Japanese Patent Application No. 2011-251347 filed on Nov. 17, 2011 and Japanese Patent Application No. 2011-255104 filed on Nov. 22, 2011. The entire disclosure of Japanese Patent Application Nos. 2011-250786, 2011-251347 and 2011-255104 is hereby incorporated herein by reference.

BACKGROUND

1. Technical Field

The present invention relates to an ink discharge part that discharges ink onto a recording medium, a recording medium conveyance apparatus that conveys the recording medium toward the ink discharge part, and a recording apparatus equipped with a control part that controls each operation of the ink discharge part and the recording medium conveyance apparatus.

2. Background Technology

In this type of the technology, Patent Document 1 can be given so as to describe a recording apparatus. A structure disclosed in this document includes a roll motor being the power source to turn a roll body in which a band-like recording medium is wound, a conveyance drive roller located in a position downstream side than the roll body in a feeding direction of the recording medium, a PF motor driving the conveyance drive roller, and a motor control part controlling a drive status of the roll motor and the PF motor to convey the conveyed recording medium in a condition given with a predetermined tension.

Since the weight of the roll body is heavy, the load becomes large when the recording medium is fed from the roll body. When the recording medium is fed and is conveyed by the driving power of the PF motor only, this might have a breakage risk of the recording medium. Thus, the roll motor is equipped to turn the roll body and the recording medium is fed by driving both the PF motor and the roll motor. The breakage risk can be relieved by this structure.

When the usage of the recording medium proceeds and the roll body pays out the recording medium, the diameter and the weight of the roll body are gradually reduced. As a result, the load applied to the roll motor, which is used for a rotation of the roll body, is changed in response to the usage of the recording medium. For the load fluctuation, the roll motor is driven in a halted state of the PF motor. Then, the measurement is executed to measure a relationship between the load while feeding the recording medium from the roll motor (the load applied to the roll motor) and the driving speed of the roll motor. Based on the obtained measurement value, the driving control of the roll motor is performed so as to reduce the effect of the load fluctuation.

In addition, to intend the high accuracy of the feeding amount of the recording medium by the PF motor, the recording medium is conveyed by driving both the roll motor and the PF motor and the driving states of the roll motor and the PF motor are controlled to convey the recording medium in a condition given with a predetermined tension.

Japanese Laid-open Patent Publication No. 2009-242048 (Patent Document 1) is an example of the related art.

SUMMARY

Problems to be Solved by the Invention

However, the roll body has been gradually growing in size (for example, length is approximately 160 cm and the weight is approximately 80 kg) and such new problems were not considered. The following points will be discussed as the new problems. The both sides of the roll body are supported by the rotary drive part configured with a part of the recording medium feeding part so that the roll body can be set as drivable. In a condition of which the roll body was set and left for a while, if this is a heavy and long roll body which appears to be larger as described above, the flexural deformation problem occurs so that the central part hangs down few millimeters in a longitudinal direction.

Since the flexural deformation occurs, the center position of the gravity of the roll body is shifted from the shaft center on line. Therefore, when the roll body goes into a single rotation, the rotational load is greatly changed and the recording medium cannot be conveyed properly.

Before the above described large roll body appears, the flexural deformation problem was not obvious so that as shown in FIG. 8A, the above described measurement was usually executed when the roll body goes into one-quarter of a rotation (90-degree in a range referring to a symbol 26), not a single rotation (360-degree roll). In the same drawing, the horizontal axil refers to the rotation amount (degree of the angle) of the roll body, and the vertical axil refers to the load applied to the motor (a duty ratio or a current value in a motor controlled by the PWM) obtained from the above described measurement result when the motor drives in one speed. In the same drawing, a symbol 24 refers to the fluctuation curves of the load applied to the motor when the roll body goes into a single rotation. A symbol 25 refers to the average of the load fluctuation curves 24.

Since the fluctuation range in the load fluctuation curves 24 was small, the measurement could be proper even though the measurement was executed in one-quarter of a rotation.

However, in a case of the above described large roll body, the flexural deformation problem becomes obvious. As shown in FIG. 8B, the fluctuation range in the load fluctuation curves 27 of the motor becomes larger, and this causes the problem that the recording medium cannot be conveyed properly. In addition, when the measurement is executed in one-quarter of a rotation, the average value 28 such as an essential required value is greatly shifted so that this also causes the problem that the recording medium cannot be conveyed properly.

When the measurement is executed in a single rotation of the roll body, the occurrence of the problem that the average value 28 such as an essential required value is greatly shifted is reduced.

However, if the measurement is simply executed at the time of a single rotation of the roll body, a significant length of the recording medium will be fed in a single rotation because the radius of the roll body (diameter) becomes larger by growing the size of the roll body. For example, if the diameter of the roll body is 30 cm, the recording medium is fed approximately 1 meter per a single rotation. Since the PF motor is stopped when the measurement is executed, the one-meter long recording medium, which was fed, cannot proceed any further than the conveyance drive roller. Therefore, this causes a condition that the recording medium overly hangs down in the peripheral part of the roll body.

When the user sees the above described condition before start printing, it is easy to make a misjudgment that the recording apparatus has some trouble. In addition, the overly hanging down part can contact the peripheral members and there is a risk for damaging a recording surface.

When the roll body goes into a single rotation and the measurement is executed, the purpose of the invention is to limit for the damage of the recording surface while suppressing the overly hangs down part. In addition, for the purpose of the invention, even if the roll body does not have to go into a single rotation, it can be efficiently handled.

Also, even if the above described rotary drive part keeps holding the roll body for long period of time and the condition continues, the purpose of the invention is to suppress the deformation of the recording medium caused by shifting the center position of the gravity of the roll body from the shaft center on line.

Means Used to Solve the Above-Mentioned Problems

A recording apparatus according to the 1st aspect of the invention to solve the above-described problems includes an ink discharge part that discharges ink onto a recording medium, a first drive part that drives a rotation of a roll body in which the recording medium is wound, a conveyance part that conveys the recording medium and is located in a position downstream side than the roll body in a conveyance direction of the recording medium, a second drive part that drives the conveyance part, a recording medium conveyance apparatus that conveys the recording medium, and a control part that controls an operation of the ink discharge part and the recording medium conveyance apparatus; wherein the control part drives the first drive part in a halted state of the second drive part and executes a measurement that measures a relationship between a load and a drive speed when conveying the recording medium; and wherein the control part executes the measurement for a single rotation of the roll body and provides a first measurement mode to execute the single rotation which is divided into plural number.

In this case, besides a roll paper which is a paper as a recording medium, "Roll body" could mean unstrained, stretchable, or flexible materials such as a plastic sheet, fabric, plastic or the like, which include a material that easily occurs the flexural deformation.

In the present aspect, the first drive part is driven in a halted state of the second drive part and executes a measurement that measures a relationship between a load and a drive speed when conveying the recording medium. The measurement is executed in a single rotation of the roll body and also, a first measurement mode is provided to execute the single rotation which is divided into plural number. In the first measurement mode, the first drive part stops when the measurement is end for one of the divided portions. In the halted state of the first drive part, the second drive part, which was stopped until then, starts driving and the feeding portion of the recording medium is sent to the downstream side of the second drive part. Accordingly, the length of the feeding portion of the recording medium for one of the portions in which the single rotation was divided is shorter than the length of the feeding portion of the recording medium when the single rotation was not divided. Also, the feeding portion of the recording medium is gone in a peripheral part of the roll body by sending it in the downstream side of the second drive part. Thus, a receivable space for a feeding portion in the next measurement can be secured when the single rotation is divided into plural number. That is, since the first feeding portion and the second feeding portion are not accumulated in the peripheral part of the roll body, a large hanging down is not easily generated in the peripheral part of the roll body. Therefore, it is less represented for the user.

As described above, in the present aspect, when the measurement is executed by a single rotation of the roll body, a breakage risk of the recording medium surface can be reduced while suppressing the large hanging down. Also, if it is not necessary that the roll body goes into a single rotation, it can be efficiently handled.

In the $2^{nd}$ aspect of the invention, the recording apparatus according to the $1^{st}$ aspect includes a feature that it provides the second measurement mode which is executed in a range of which the roll body does not go into a single rotation. When the measurement is properly performed without a single rotation of the roll body, the second measurement mode is executed so that it can be possible to save more time.

In the $3^{rd}$ aspect of the invention, the recording apparatus according to the $2^{nd}$ aspect includes a feature that when the fluctuation band of the load obtained by the execution of the first measurement mode is less than a setting value, the control part executes the next measurement in the second measurement mode. In the present aspect, when the fluctuation band of the load obtained by the execution of the first measurement mode is less than a setting value, the next measurement is executed in the second measurement mode. Accordingly, the measurement can be executed by efficiently selecting a proper measurement mode.

In the $4^{th}$ aspect of the invention, the recording apparatus according to the $1^{st}$ aspect includes a feature that the control part executes the measurement in the first measurement mode immediate after the roll body was replaced. When the roll body is replaced, the recording apparatus normally does not have the information of the flexural deformation. By the present aspect, the measurement is executed in the first measurement mode immediate after the roll body was replaced so that it is possible to realize a proper measurement.

In the $5^{th}$ aspect of the invention, the recording apparatus according to the $1^{st}$ aspect includes a feature that the control part performs to divide a single rotation of the roll body into even number of portions for the first measurement mode and one-half of the single rotation is performed in a one direction and a remaining one-half of the single rotation is performed in another direction. It can be possible to perform a reverse rotation for the remaining one-half of a single rotation because the load fluctuation of the first drive part in a single rotation of the roll body has a symmetry relation even if a reverse rotation (rotation in another direction) is performed. In the present aspect, there is a configuration that the measurement is performed in a reverse rotation for the remaining one-half of a single rotation so that the total feeding amount in a single rotation of the roll body can be reduced in a half. Also, by this point, a breakage risk of the recording medium surface can be more effectively reduced while suppressing a large hanging down part.

In the $6^{th}$ aspect of the invention, the recording apparatus according to the $1^{st}$ aspect includes a feature that the first drive part is controlled by a PWM control. The control part performs to divide a single rotation of the roll body into even number of times for the first measurement mode. The divided portions in a single rotation are separated into odd number of times and even number of times and the first drive part drives at a first speed in one side and the first drive part drives at a second speed, which is faster than the first speed, in another side.

When the speed of the first drive part is controlled by the PWM control, it is affected by a counter-electromotive force associated with the rotation of the first drive part. By the present aspect, the first measurement mode is executed in the divided portions of a rotation which are separated into odd number of times and even number of times and the first drive part drives at a low drive speed (first speed) in one side and the first drive part drives at a high speed drive (second speed), which is faster than the first speed, in another side. Accordingly, the effect of the counter-electromotive force can be reduced.

Here, the PWM control is the abbreviation for the "Pulse Width Modulation" control. The PWM control uses a modulation method in which a duty ratio of a pulse wave is changed and is modulated.

In the $7^{th}$ aspect of the invention, the recording apparatus according to the $1^{st}$ aspect includes a feature that [0023] the control part provides a first control mode that controls the operation of the ink discharge part and the recording medium conveyance apparatus which are related to the execution of recording to the recording medium, and the control part also provides a second control mode that executes an operation of a rotation of the roll body when a setting time is passed in a halted state of a rotation of the roll body and in a condition that the roll body is mounted on the rotation drive part.

In a case of which "the second control mode" is executed, this could include, for example, a case that a setting time is passed in a condition immediate after the roll body was replaced, or a case that in a condition rewinding the roll body between the time ending one of the operations in the first control mode and the time starting a next operation and also, a setting time is passed after a rotation stop.

In the present aspect, besides the first control mode that controls an operation related to the execution of recording to the recording medium, when a setting time is passed in a halted state of a rotation and in a condition that the roll body is mounted on the rotary drive part, the second control mode is provided to execute a rotary operation under a condition that the roll body was set through the motor control part. Accordingly, even if a condition that the roll body is mounted on the rotary drive part keeps for a long period of time, the flexural deformation caused by shifting the center position of the gravity of the roll body from the shaft center on line can be suppressed.

In the $8^{th}$ aspect of the invention, the recording apparatus according to the $1^{st}$ aspect includes a feature that the second control mode executes the roll body by repeating operations of a half rotation, a stop rotation, a half rotation, and a stop rotation.

In the present aspect, the up and down relationship of the roll body turns upside down before and after each one-half of a single rotation because the roll body turns in a half rotation. Accordingly, the flexural deformation can be effectively corrected. In addition, if it is configured to vary the stop time, the flexural deformation is effectively corrected for the proper roll body or it can be realized that the generation of the flexural deformation in itself can be effectively suppressed.

In the $9^{th}$ aspect of the invention, the recording apparatus according to the $7^{th}$ aspect includes a feature that the first drive part is controlled by the PWM control, and the rotation of the roll body in the second drive mode is performed in a lower duty ratio than the rotation of the roll body in the first control mode.

That is, the speed of the first drive part is controlled by the PWM control, and the rotation of the roll body in the second drive mode is performed in a lower duty ratio than the rotation of the roll body in the first control mode.

According to the present aspect, in addition to each effect of the above aspects, the second control mode is performed in a low duty ratio of the PWM control so that it is possible to obtain the benefit of the $1^{st}$ aspect or the $2^{nd}$ aspect in a low electrical charge.

In the $10^{th}$ aspect of the invention, the recording medium according to the $7^{th}$ aspect includes a feature that the control part performs the measurement in the first measurement mode immediate after the second control mode was executed.

After the execution of the second control mode when the roll body was replaced or the like, it does not have any information about the flexural deformation of a new roll body. Even though the flexural deformation of the roll body is suppressed by the execution of the second control mode, it still does not have any information about the degree of the actual flexural deformation.

According to the present aspect, it is configured that the first measurement mode is performed for the first measurement immediate after the second control mode was executed when the roll body was replaced, or the like, so that in addition to the benefit of each of the above aspects, it can be realized to execute the measurement properly.

BRIEF DESCRIPTION OF THE DRAWINGS

Referring now to the attached drawings which form a part of this original disclosure.

DETAILED DESCRIPTION OF EXEMPLARY EMBODIMENTS

Figure 1:
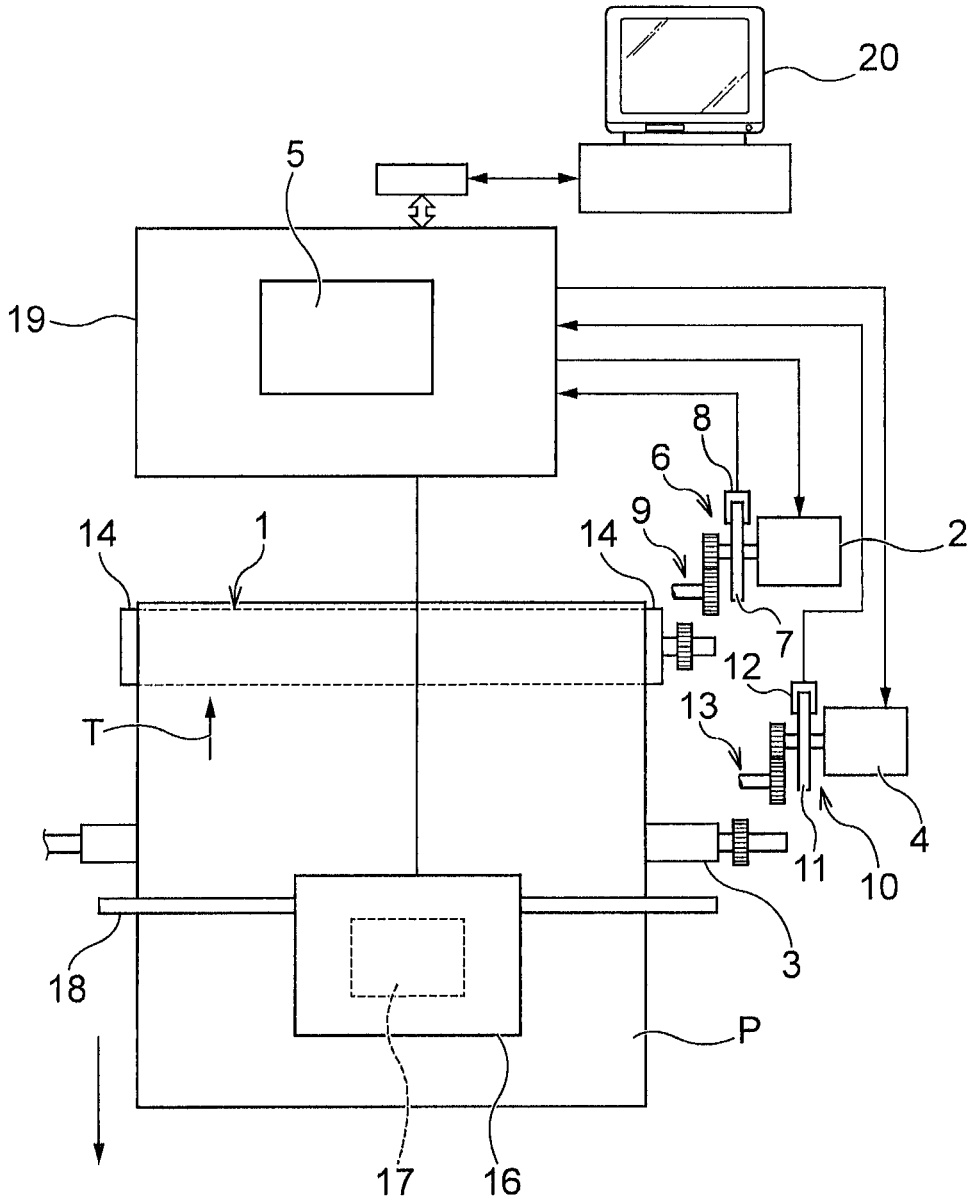
FIG. 1 shows a schematic diagram of the recording apparatus in an embodiment of the invention.

First of all, a general configuration of an inkjet recording apparatus, which is one embodiment of the recording apparatus in the invention, is schematically explained as shown in FIG. 1.

The recording apparatus of the invention includes an ink discharge part 17 that discharges ink onto a recording medium P, a rotary drive part 9 on which a roll body 1 rolled with the recording medium P is rotatably mounted, a first motor 2 in response with a first drive part to drive the rotary drive part 9, a conveyance drive roller 3 that conveys the recording medium P and the conveyance drive roller positioned in a downstream side than the roll body 1 in a conveyance direction of the recording medium P, a second motor 4 that drives the conveyance roller 3, a recording medium conveyance roller 30 that conveys the recording medium P, and a control part 19 that controls each operation of the ink discharge part 17 and the recording medium conveyance apparatus 30.

The control par 19 provides a first control mode to control the operation of the ink discharge part 17 and the recording medium conveyance part 30 and they are related to the execution of recording onto the recording medium. In a condition that the roll body 1 is mounted on the rotary drive part 9, the control part 19 also provides a second control mode to perform the rotary operation of the roll body 1 when the setting time in a halted state of a rotation has been passed.

The first motor 2 (hereinafter referred to as "a motor for the roll body") uses a rotary encoder as a rotation detection part 6 and is equipped with a disk-shaped scale 7 and a rotary sensor 8. The rotative power of the first motor 2 is transmitted to the rotary drive part 9 equipped in the roll body 1 through a gear train. In the drawing, a symbol 14 refers to a rotative holder inserted into the both sides of the roll body 1.

The second motor 4 (hereafter referred to as "PF motor") also uses a rotary encoder as a rotation detection part 10 and is equipped with a disk-shaped scale 11 and a rotary sensor 12. The rotative power of the second motor 4 is transmitted to the conveyance drive roller 3 through a gear train 13.

The control part 19 controls the whole operation of the recording apparatus. The control part 19 includes a motor control part 5 that controls to drive the first motor 2 and the second motor 4. The printing data is sent to the control part 19 from a computer 20.

As shown in FIG. 1, the ink discharge part 17 is mounted on a carriage 16. There is a structure that the carriage 16 is guided by a carriage guide shaft 18 based on a reception of a control signal sent from the control part 19 so as to reciprocate in a width direction of the recording medium which intersects a conveying direction of the recording medium 1.

Figure 2:
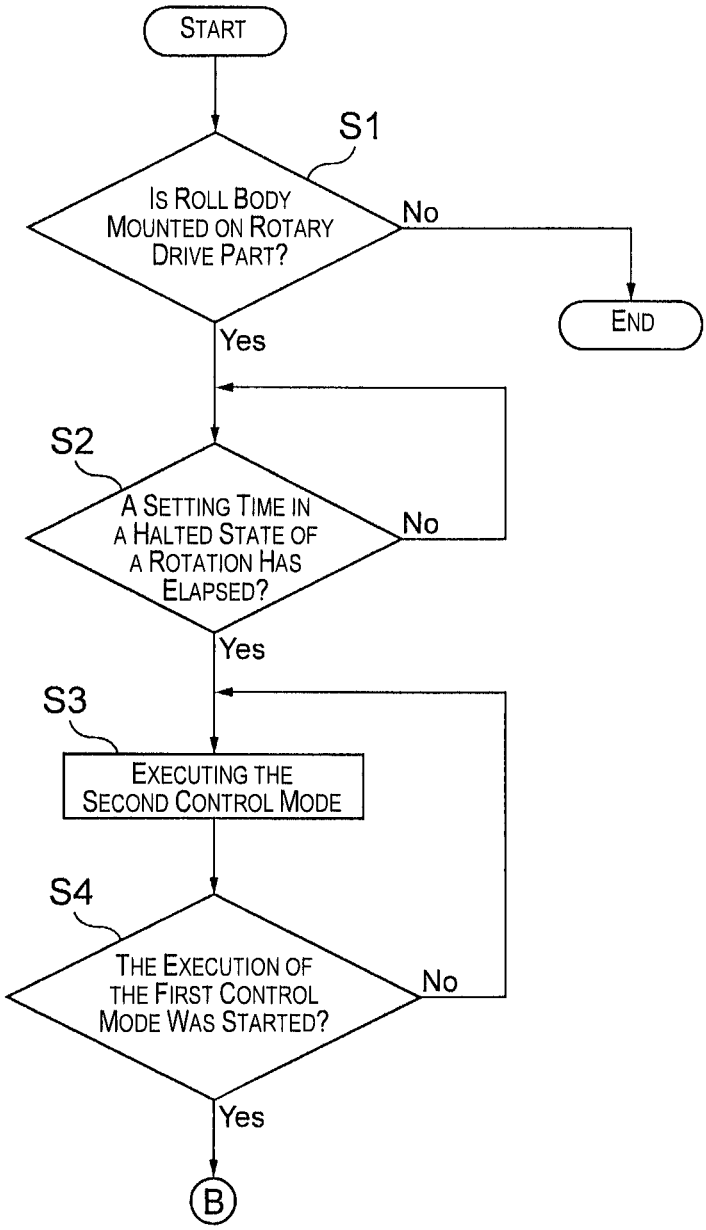
FIG. 2 shows a flowchart describing a control flow of the control part of the recording apparatus in the same embodiment.

Next, the control flow of the control part 19 will be explained based on the flowchart in FIG. 2.

First, it determines whether the roll body 1 is mounted on the rotary drive part 9 in Step S1. The determination is made based on the mounting information, which is included in a printing data entered by the user through the computer 20, or the determination is made based on the mounting information which is directly entered from a control panel that is not shown in the drawing of the recording apparatus. Once the roll body 1 is mounted on the rotary drive part 9, it determines that the roll body is mounted until the information that the roll body is removed will be sent.

When it determines "the roll body is mounted" in Step S1, the process proceeds to Step S2. In the mounted condition of the roll body, it determines whether the setting time for a halted state of a rotation of the roll body was passed. The elapsed time in the halted state of the rotation is measured by the rotation halting information sent from the rotation detection part 6 to the control part 19 and a time measurement part (not shown in the drawing) provided in the control part 19.

When it determines "the setting time was passed" in Step S2, the process proceeds to Step S3 and the second control mode 32 is executed. In the second control mode 32, the first motor 2 is driven in order to prevent the occurrence of the flexural deformation and the roll body 1 is operated to rotate in a set rotation amount, a set rotation direction, and a set rotation speed.

Next, the process proceeds to Step S4 and it determines whether the execution of the first control mode 31 is begun. The determination is also made based on the information entered by the user through the computer 20, or the determination is made based on the information which is directly entered from a control panel that is not shown in the drawing of the recording apparatus. When it determines the execution of the first control mode 31 was begun, the process proceeds to the measurement operation. This measurement operation will be described later.

In Step S4, when it determines that the operation of the first control mode 31 was not begun, it returns to Step S3 and the operation of the second control mode 32 continues. By this process, the flexural deformation of the roll body can be suppressed.

In Step S1, when it determines that the roll body 1 was not mounted on the rotary drive part 9, the control process proceeds to the end.

In this embodiment, besides the first control mode 31 performs the operation related to the execution of recording onto the recording medium P, the control part 19 also provides the second control mode 32 that performs the operation to rotate the roll body 1 under the condition set through the motor control part 5 when the setting time in a halted state of a rotation of the roll body 1 mounted on the rotary drive part 9 was passed. Accordingly, even when the roll body 1 keeps for long time in a condition of mounting on the rotary drive part 9, the flexural deformation caused by the central position of the gravity of the roll body 1 shifted from the shaft center on line can be suppressed.

The "setting condition" in "the rotary operation under the setting condition of the roll body" means a condition setting the physical amount related to the rotary condition such as a rotation amount, a rotation direction, and a rotation speed. The "setting time" and the "setting condition" are preferred to be a variable structure in order to improve the user's usability.

In the present embodiment, the second control mode 32 is set operating the roll body 1 that repeats rotating one-half of a single rotation and a stop rotation, one-half of a single rotation and a stop rotation.

By this operation, the up and down relationship of the roll body 1 flips upside down approximately at the time of the one-half of a single rotation because the roll body 1 rotates one-half of a single rotation. Accordingly, the flexural deformation can be effectively corrected. In addition, since the halted time is variable, the flexural deformation can be effectively corrected to proper for the roll body 1, or it realizes that the occurrence of the flexural deformation in itself can be effectively suppressed.

Moreover, in the present embodiment, the speed of the first motor 2 is controlled by the PWM control, and there is a configuration that the rotation of the roll body 1 in the second control mode 32 is operated in a lower duty ratio than the rotation of the roll body 1 in the first control mode 31.

By this configuration, the second control mode 32 operates in the lower duty ratio of the PWM control so that it is possible to obtain the benefit in the low amount of the electricity.

Next, the measurement operation of the first motor will be explained.

In the present embodiment, the motor control part 5 controls a drive state of the first motor 2 and the second motor 4 in order to convey the recording medium P given with a predetermined tension T. Also, the motor control part 5 executes a single rotation of the roll body 1 to measure between a load D and a drive speed V as a measurement when the first motor 2 feeds the recording medium P in a halted state of the second motor 4. In addition, the first measurement mode is provided to execute a single rotation which is divided into plural number, and the second measurement mode is provided to execute a rotation in a range that the roll body 1 does not go into a single rotation.

Also, in the present embodiment, it is configured that the first measurement executes in the first measurement mode immediate after the execution of the second control mode when the roll body 1 was replaced, or the like.

Moreover, when the fluctuation band of the load obtained in the execution of the first measurement mode is less than a set value, it is configured that the next measurement will be executed in the second measurement mode.

Based on FIGS. 3, 4 and 5B, the measurement operation in the first measurement mode of the present embodiment will be explained.

In the present embodiment, the single rotation of the roll body is divided into eight times. The measurement is executed when one-half of a full rotation of the roll body 1 rotates in a positive rotation and the remaining one-half of a rotation rotates in a negative rotation.

The speed of the first motor 2 is controlled by the PWM control. The divided rotations are separated into odd number of times such as $1^{st}$ time, $3^{rd}$ time, $5^{th}$ time, $7^{th}$ time and even number of portions such as $2^{nd}$ time, $4^{th}$ time, $6^{th}$ time, $8^{th}$ time. In the odd number of times, the first motor 2 is performed in a low speed VL drive (L1, L2, L3, L4 of FIG. 5) and in the even number of times, the first motor 2 is performed in a high speed VH drive (H2, H4, H6, H8 of FIG. 5) which is higher speed than the odd number of times.

Figure 3A:
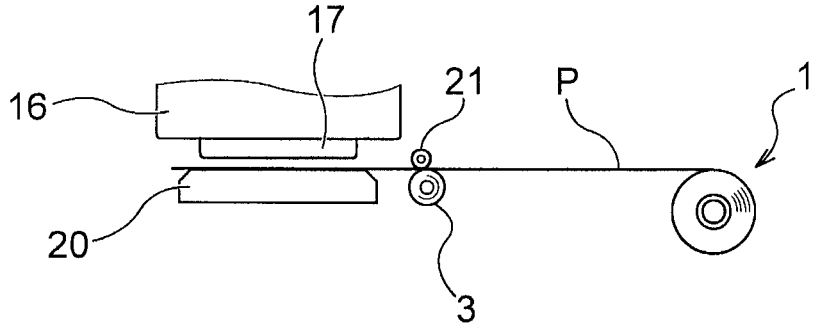
FIGS. 3A, 3B, and 3C are schematic side elevational views describing a first half of measurement execution operations in the recording medium conveyance apparatus in the same embodiment.

FIG. 3A shows a condition describing the right before executing the measurement in the halted state of the first motor 2 and the second motor 4. In other words, the conveyance drive roller 3 stops and the roll body 1 also stops rotating.

Figure 3B:
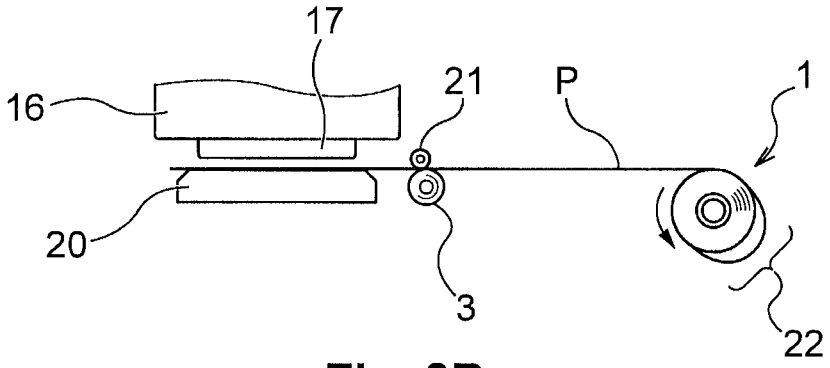

FIG. 3B shows a condition that the first motor 2 drives one-eighth of a rotation in the low speed VL drive in the halted state of the second motor 4. The hanging down portion 22 which is equivalent to the one-eighth of a rotation is generated in the peripheral part of the roll body 1. However, it is less represented for the user because the amount equivalent to the one-eighth of a rotation, not the single rotation, is small. And, by this operation, the measurement of the first motor 2 is executed for the one-eighth of a rotation of the roll body 1. In detail, the duty ratio DL1 corresponding to the low speed VL drive is obtained.

Figure 3C:
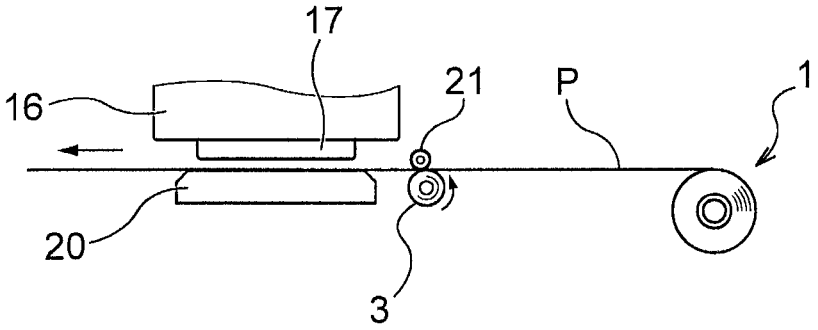

Next, FIG. 3C shows a condition that the second motor 4 drives a rotation to send the hanging down portion 22 to the downstream side while keeping the halted state of the first motor 2.

Next, the measurement in the $2^{nd}$ time of the one-eighth of a single rotation is performed by the same operations of FIGS. 3A to 3C at the high speed VH drive ($1^{st}$ time). By this operation, the duty ratio DH1 corresponding to the high speed VH drive is obtained.

Next, the measurement in the $3^{rd}$ time of the one-eighth of a rotation is performed at the low speed VL drive ($2^{nd}$ time) so as to obtain the duty ratio DL2 corresponding to the low speed VL drive.

Next, the measurement in the $4^{th}$ time of the one-eighth of a rotation is performed at the high speed VH drive ($2^{nd}$ time) so as to obtain the duty ratio DH2 corresponding to the high speed VH drive.

Figure 4E:
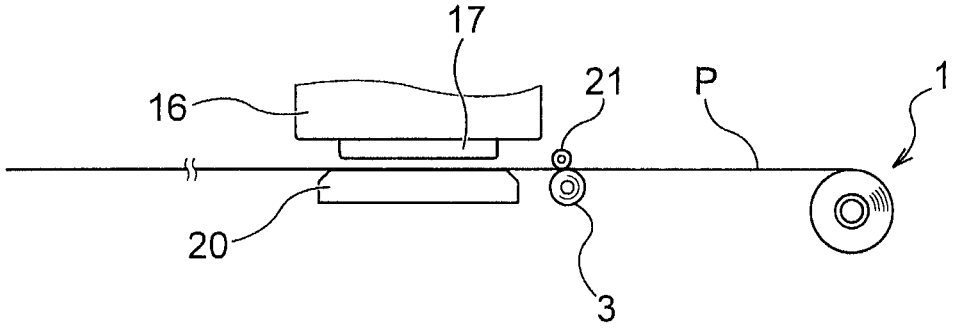
FIGS. 4E, 4F, and 4G are schematic side elevational views describing a second half of measurement execution operations in the recording medium conveyance apparatus in the same embodiment.

Following that, FIG. 4E shows a condition describing immediate before executing the $2^{nd}$ half of the measurement in a negative rotation in the halted state of the first motor 2 and the second motor 4. In other words, the conveyance drive roller 3 stops and the roll body 1 also stops rotating.

Figure 4F:
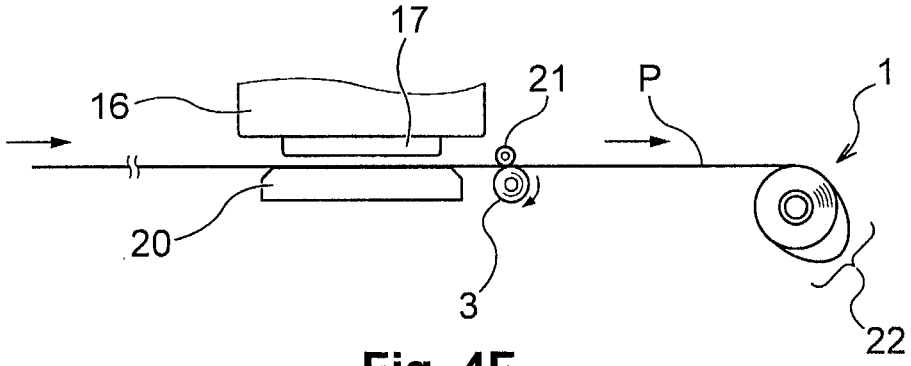

FIG. 4F shows a condition that the second motor 4 drives equivalent to the one-eighth of a rotation in the halted state of the first motor 2. The hanging down portion 22 which is equivalent to the one-eighth of a rotation is generated in the peripheral part of the roll body 1.

Figure 4G:
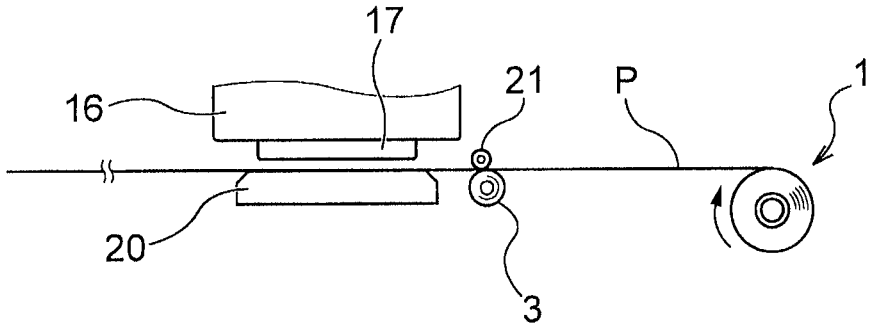

Next, FIG. 4G shows a condition that the hanging down portion 22 was rolled up to the inside of the roll body by driving the first motor 2 in the low speed VL drive ($3^{rd}$ times) while keeping the halted state of the second motor 4. The duty ratio DL 3 corresponding to the low speed VL drive is obtained.

Next, the measurement in the $2^{nd}$ time of the one-eighth of a rotation in the negative rotation is performed by the same operations of FIGS. 4E to 4G at the high speed VH drive ($3^{rd}$ time). By this operation, the duty ratio DH3 corresponding to the high speed VH drive is obtained.

Next, the measurement in the $3^{rd}$ time of the one-eighth of a rotation in the negative rotation is performed at the low speed VL drive ($4^{th}$ time) so as to obtain the duty ratio DL 4 corresponding to the low speed VL drive.

Next, the measurement in the $4^{th}$ time of the one-eighth of a rotation in the negative rotation is performed at the high speed VH drive ($4^{th}$ time) so as to obtain the duty ratio DH4 corresponding to the high speed VH drive.

Figure 6:
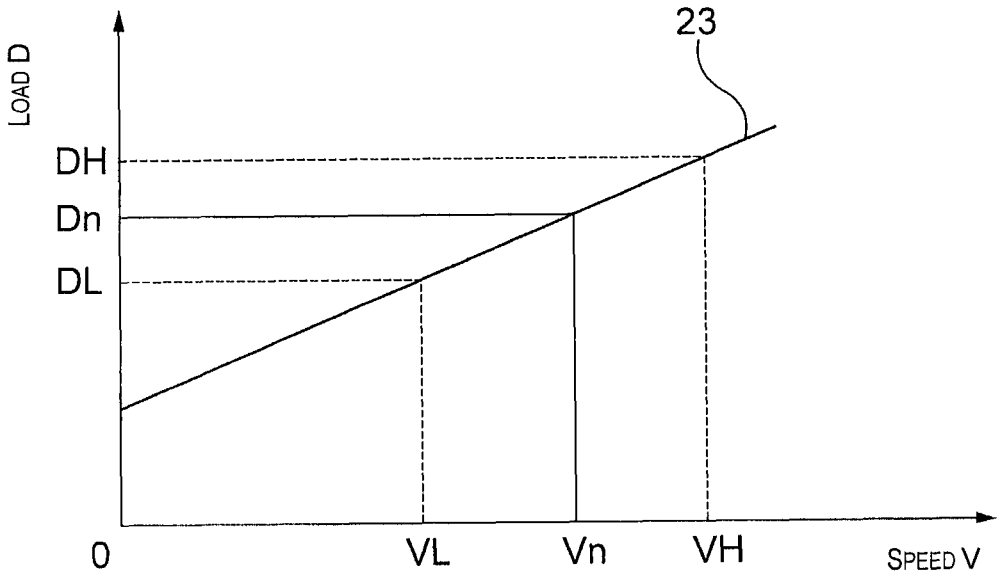
FIG. 6 shows a graph describing the result of the measurement in the recording medium conveyance apparatus in the same embodiment.

With that, the measurement operation in the first measurement mode is end. The duty ratio DL, which is equivalent to a load applied to the first motor 2 at the low speed drive, is obtained by averaging the obtained four duty ratios DL1 to DL 4. Also, the duty ratio DH, which is equivalent to a load applied to the first motor 2 at the high speed drive, is obtained by averaging the obtained four duty ratios DH1 to DH4. They are plotted as shown in FIG. 6. A straight line 23 in FIG. 6 refers to the relationship between a load D and a drive speed V of the first motor 2 when feeding the recording medium P in the halted state of the second motor 4.

Based on the relationship between the load D and the drive speed V, the control part 19 controls the driving of the first motor 2. In detail, the drive speed or the torque of the first motor 2, which is set before executing the measurement, is changed and the feeding amount when conveying the recording medium is corrected after executing the measurement.

As explained above, in the present embodiment, the motor control part 5 executes a single rotation of the roll body 1 so as to provide the measurement to measure the relationship between the load D and the drive speed V when the first motor 2 feeds the recording medium P in the halted state of the second motor 4. In addition, it provides the first measurement mode which executes a single rotation divided into plural number and the second measurement mode which executes a rotation in a range of which the roll body 1 does not rotate a single rotation.

Accordingly, in the first measurement mode, it does not generate the large hanging down portion 22 in the peripheral part of the roll body and it is less represented for the user because a feeding length divided for one time is short.

The first motor 2 stops immediate after the first measurement was done. When the first motor is in a halted state, the second motor 4, which was stopped until then, starts driving so that the feeding portion 22 is sent to the downstream side of the second motor 4 and it is gone from the peripheral part of the roll body. Because of this, the receivable space of the feeding part can be secured for the execution of the next measurement. And, the previous time that is the part fed in the first time and the part fed in the second time are not accumulated in the peripheral part of the roll body 1 so that it is less represented for the user.

In addition, in the invention, it provides the second measurement mode which executes a rotation in a range that the roll body 1 does not go into a single rotation. Therefore, when the flexural deformation is small and the roll body does not have to go into a single rotation to perform the measurement properly, the measurement time can be shortened by executing the second measurement mode.

Further, when the second control mode is executed immediate after the roll body 1 was replaced or the like, the recording apparatus does not normally have the information of the flexural deformation about a new roll body 1. However, in the invention, it can be realized to execute the measurement properly immediate after the roll body 1 was replaced because there is a configuration that the first measurement, which is immediate after the execution of the second control mode, is executed in the first measurement mode.

Moreover, in the invention, there is a configuration that when the fluctuation band of the load obtained by executing in the first measurement mode is less than the setting value, the next measurement will be executed in the second measurement mode. Therefore, the measurement can be executed by selecting the proper measurement mode efficiently.

Since there is a configuration that the measurement is performed by the negative rotation for the remaining one-half of a rotation, the total feeding amount by the single rotation of the roll body 1 can be reduced to half. From this point, the breakage risk to the recording medium can be effectively reduced while suppressing the large hanging down.

Further, when the speed of the first motor 2 is controlled by the PWM control, it is affected by the counter-electromotive force associated with the rotation of the motor. According to the invention, the measurements are executed by separating the odd numbers (L1, L2, L3, L4 of FIG. 5) of times in the divided rotation and the even numbers (H2, H4, H6, H8 of FIG. 5) of times in the divided rotation so that in the one side, the first motor 2 is driven at the low speed VL drive, and in another side, the first motor is driven at the high speed VH drive. Accordingly, the effect of the counter-electromotive force can be reduced.

Figure 5A:
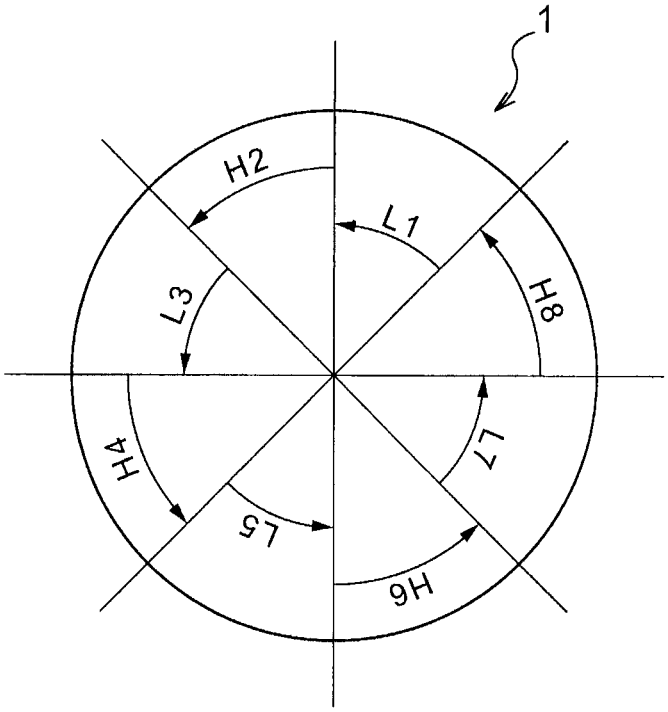
FIGS. 5A and 5B are schematic side elevational views describing two aspects of measurement execution operations in the recording medium conveyance apparatus in the same embodiment.
Figure 5B:
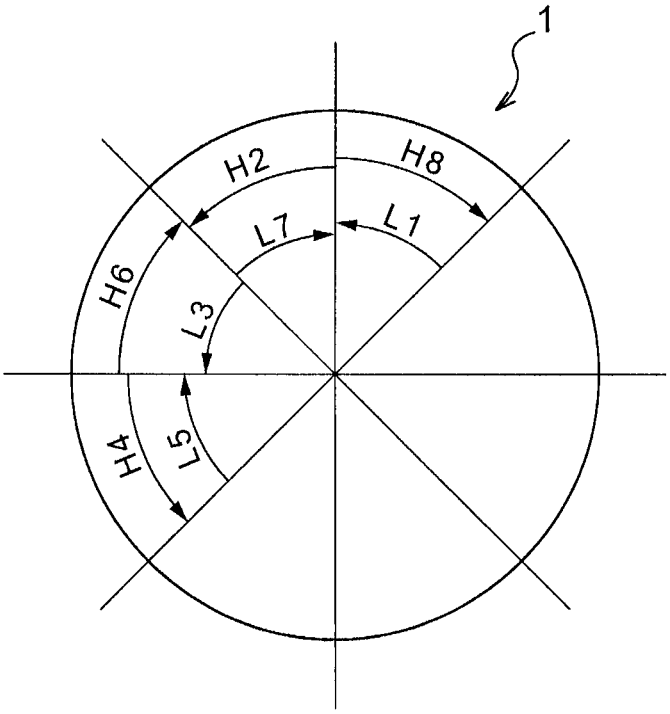

Also, the above embodiment was explained to show that the measurements, which were divided by eight, were performed as shown in FIG. 5B but according to FIG. 5A, it can be possible to perform the measurements, which are divided by eight, in a single rotation of the roll body 1 in one direction only.

Figure 7:
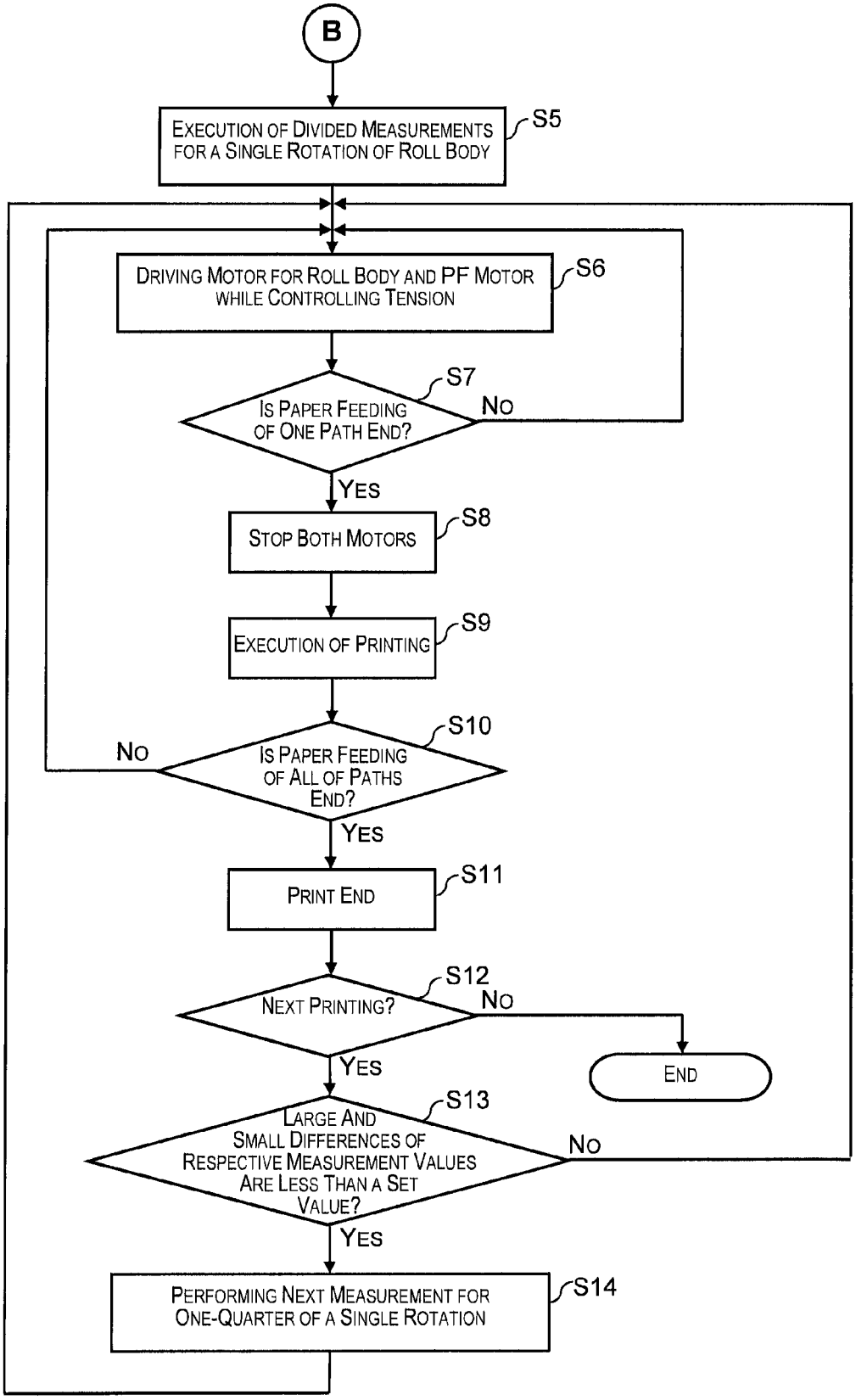
FIG. 7 shows a flowchart describing the operation of the recording apparatus equipped with the recording medium conveyance apparatus in the same embodiment.
Figure 8A:
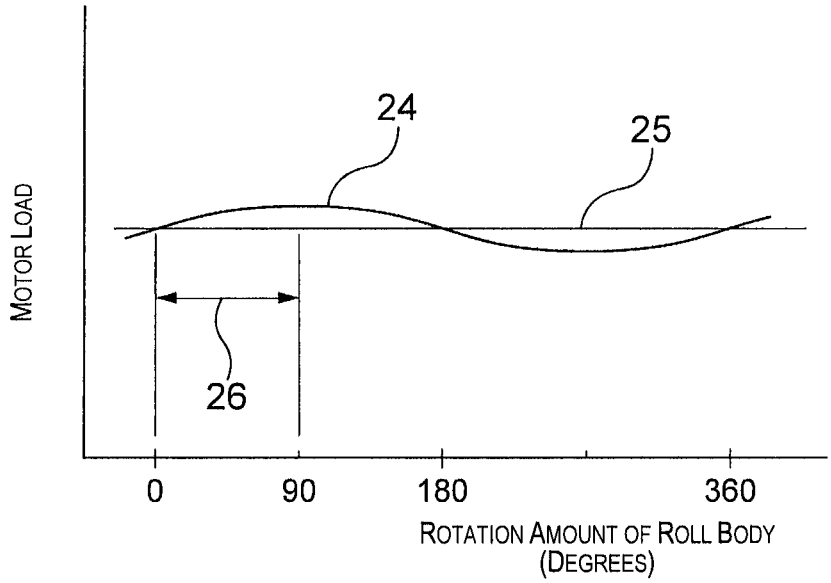
FIG. 8A describes a measurement in the past and the FIG. 8B describes the issues of the invention.
Figure 8B:
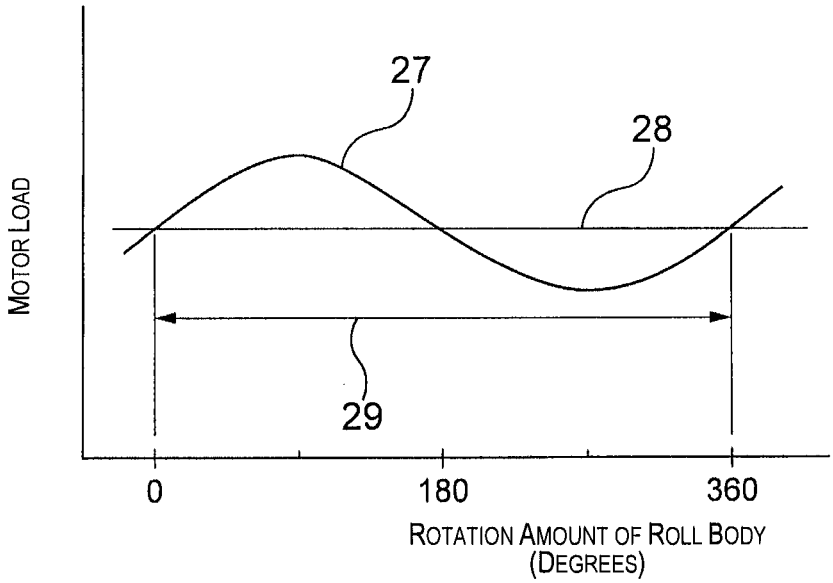

Next, the measurement operation of the recording apparatus will be explained based on the flowchart in FIG. 7.

In Step S5, the divided measurements (divided by eight in the present embodiment) are executed for a single rotation of the roll body 1 as described above. By this operation, a straight line 23, which refers to the relationship between the load D and the drive speed V of the first motor when feeding the recording medium P in a halted state of the second motor 4 as shown in FIG. 6, is obtained.

Next, in Step S6, the driving conditions of the first motor (motor for the roll body) 2 and the second motor (PF motor) 4 are controlled to convey the recording medium P with a condition given by a predetermined tension T. In this control, when the feeding speed of the recording medium P conveyed by the driving power of the second motor 4 is Vn, as a duty ratio of the rotary drive of the first motor 2, the first motor 2 is driven in a load Dn provided in FIG. 6. In this case, the feeding speed of the second motor 4 and the feeding speed of the first motor 2 become the same so that the above tension is not given. For this reason, a duty ratio given to the first motor 2 becomes smaller than a value corresponding to the load Dn so that the feeding speed of the second motor 4 is set to be faster than the feeding speed of the first motor 2. That is, it can be executed based on the actual measurement values detected in the rotation detection part 6 equipped with the first motor 2 and the rotation detector 10 equipped with the second motor 4. Therefore, it is possible to convey the recording medium P in a condition given with a predetermined tension T.

In Step S7, the both motors 2 and 4 are driven until the end of feeding the recording medium (paper feeding) for one path, and the both motors 2 and 4 stop when the feeding for one path is end (Step S8). The decision is also made by the motor control part 5 based on the actual measurement value detected in the rotation detector 10 equipped with the second motor 4.

Next, a printing is executed by discharging ink in the ink discharge part 17 (Step S9). And, the feeding for all of paths is end (Step S10). That is, when a single job is end, this is the end printing of the job (Step S11).

Next, in Step S12, a determination is made whether there is a next job. If there is a next job, the large and small differences of each measurement value obtained by executing the first measurement mode, that is, whether or not the fluctuation band of the load is less than the set value is determined (Step S13).

If the result is less than the set value, the next measurement will be performed in the second measurement mode (Step S14). In this example, the measurement is performed in one-quarter of a full rotation of the roll body 1. And, returning to Step S2, the described operation is performed by the measurement value obtained in one-quarter of a full rotation of the roll body 1.

In Step S3, if the fluctuation band of the load is not less than the set value, it returns to Step S5 and the operation is repeated.

OTHER EMBODIMENT

The recording apparatus related to the invention has the fundamental structure as described above but it can be possible to change or omit a part of the structure which does not extend beyond the range of the essential parts of the invention.

For example, the control of the first motor 2 does not have to be the PWM control and it can be a voltage control in response to a load fluctuation.

The entire disclosure of Japanese patent Application No. 2011-250786, filed Nov. 16, 2011, No. 2011-251347, filed Nov. 17, 2011 and No. 2011-255104, filed Nov. 22, 2011 are expressly incorporated by reference herein.

What is claimed is:

1. A recording apparatus comprising:

an ink discharge part that discharges ink onto a recording medium;

a first drive part that drives a rotation of a roll body in which the recording medium is wound;

a conveyance part that conveys the recording medium and is located in a position downstream side than the roll body in a conveyance direction of the recording medium;

a second drive part that drives the conveyance part; and a control part that controls an operation of the ink discharge part, the first drive part, the conveyance part, and the second drive part;

wherein the control part drives the first drive part in a halted state of the second drive part and executes a measurement that measures a relationship between a load and a drive speed when conveying the recording medium;

wherein the control part executes the measurement for a rotation of the roll body and provides a first measurement mode to execute the rotation which is divided into plural number.

2. The recording apparatus according to claim 1, wherein the control part performs to divide the rotation of the roll body into even number of times for the first measurement mode and one-half of the rotation is performed in a one direction and a remaining one-half of the rotation is performed in another direction.

3. The recording apparatus according to claim 1, wherein the first drive part is controlled by a PWM control, the control part performs to divide the rotation of the roll body into even number of times for the first measurement mode, the divided rotation is separated into odd number of times and even number of times, the first drive part drives at a first speed in one side and the first drive part drives at a second speed, which is faster than the first speed, in another side.

4. The recording apparatus according to claim 1, wherein the control part provides a second measurement mode to execute the measurement in a range of that the roll body does not go into the rotation.

5. The recording apparatus according to claim 4, wherein when a fluctuation band of the load is less than a set value, the control part executes a next measurement in the second measurement mode.

6. The recording apparatus according to claim 4, wherein the control part executes the measurement immediate after a replacement of the roll body in the first measurement mode.

7. The recording apparatus according to claim 1, wherein the control part provides a first control mode that controls the operation of the ink discharge part, the first drive part, the conveyance part, and the second drive part which are related to the execution of recording onto the recording medium, the control part also provides a second control mode that executes an operation of the rotation of the roll body when a setting time is passed in a halted state of the rotation of the roll body and in a condition that the roll body is mounted on the rotation drive part.

8. The recording apparatus according to claim 7, wherein the second control mode executes the roll body by repeating operations of a half rotation, a stop rotation, a half rotation, and a stop rotation.

9. The recording apparatus according to claim 7, wherein the first drive part is controlled by the PWM control, the rotation of the roll body in the second drive mode is performed in a lower duty ratio than the rotation of the roll body in the first control mode.

10. The recording apparatus according to claim 7, wherein the control part performs the measurement in the first measurement mode immediate after the second control mode was executed.

11. A recording medium conveyance method in a recording medium conveyance apparatus that comprises a first drive part that drives a rotation of a roll body in which the recording medium is wound, a conveyance part that conveys the recording medium and is located in a position downstream side than the roll body in a conveyance direction of the recording medium, and a second drive part that drives the conveyance part, and the recording medium conveyance method in the recording medium conveyance apparatus that conveys the recording medium comprising the steps of:

driving the first drive part in a halted state of the second drive part;

executing a measurement for a rotation of the roll body and the measurement that measures a relationship between a load and a drive speed when conveying the recording medium;

dividing the rotation into plural number and executing a rotation;

controlling the drive of the first drive part based on a result of the measurement; and conveying the recording medium.

* * * * *